US006035447A

United States Patent [19]

Hsia

[11] Patent Number: 6,035,447

[45] Date of Patent: Mar. 14, 2000

[54] HALLOWEEN MASK WITH FLASH DEVICE

[76] Inventor: Ben M. Hsia, 27756 Ave. Mentry, Santa Clarita, Calif. 91355

[21] Appl. No.: 09/027,917

[22] Filed: Feb. 23, 1998

[51] Int. Cl.[7] ..... A42B 1/00

[52] U.S. Cl. ..... 2/206; 2/202; 2/906; 362/105

[58] Field of Search ..... 2/206, 906, 173, 2/202; 362/105

*Primary Examiner*—Diana Oleksa

*Attorney, Agent, or Firm*—Raymond Y. Chan; David and Raymond

[57] ABSTRACT

A Halloween mask with flash device, which not only can increase the attractive effect and the sense of reality for the mask but also can enhance the safety of the wearer by calling the attention and awareness of the vehicle drivers near the wearer, includes a hollow mask body and at least a flash device. The hollow mask body, which is made of resilient material, is punctured with a plurality of apertures at predetermined positions. The flash device includes a base housing having an upper chamber and a lower cavity, a flashing unit being received in the upper chamber, a predetermined number of button cell being received in the lower cavity and electrically connected with the flashing unit, a cell cover head detachably connected to a bottom end of the base housing so as to cover the lower cavity and the button cell therein, and a lens member affixed on top of the base housing so as to cover the upper chamber and the flashing unit therein. A neck portion is defined on the base housing between the lens member and the cell cover head, so that the flash device can be mounted on the mask body by positioning the neck portion at the corresponding aperture on the mask body while the lens member and the cell cover head respectively propping against an exterior surface and an interior surface of the mask body so as to hold the flash device in position.

14 Claims, 3 Drawing Sheets

HALLOWEEN MASK WITH FLASH DEVICE

FIELD OF THE PRESENT INVENTION

The present to invention relates to Halloween mask, and more particular to a Halloween mask having automatic flash device to provide continuous flashing light at any desired position on the mask so as to increase the sense of reality for the mask and enhance the safety of the wearer.

BACKGROUND OF THE PRESENT INVENTION

Various kinds of decorative mask are commonly used in make up parties and especially during Halloween. Most popular masks imitate famous people's faces or some horrible terrors or monsters. Traditional masks are commonly made of resilient materials such as plastic, rubber and resin material to form a hollow head shape body by means of molding, as shown in FIG. 1. The hollow head shape body is adapted to cover the wear's head.

However, none of the traditional mask can provide lighting or flashing effect since its interior surface is close to the wearer's face, that falls to provide enough room to install any conventional light bulb and electrical power source. Some manufacturers design a kind of mask having a plurality of small light bulbs or LEDs mounted on the exterior surface of the mask, wherein electrical wires must be connected with such light bulbs or LEDs and extended to a battery box hanged on the wearer's waist. It is apparent that this design is failure in market because no consumer accepts the electrical wires extending all over the mask and body.

In fact, if the mask can provide lighting or flashing thereon, it not only can be more attractive but also can increase the sense of reality for the mask. Moreover, during Halloween, many children wear Halloween masks while walking around to solicit treats at dark night. It can also enhance the safety of the wearer if the mask can provide lighting or flashing to call the vehicle drivers' awareness.

To provide lighting or flashing effect is a well know art. Light bulb and LED energized with DC battery is a general way. But, how to easily and firmly install a lighting or flashing apparatus on the traditional mask without altering the structure of the mask in an inexpensive way is an unsolved problem in the mask production industry.

SUMMARY OF THE PRESENT INVENTION

The main object of the present invention is to provide a Halloween mask with flash device which not only can increase the attractive effect and the sense of reality for the mask but also can enhance the safety of the wearer by calling the attention and awareness of the vehicle drivers near the wearer.

Another object of the present invention is to provide a Halloween mask with flash device, wherein the flash device is easy to selectively and firmly mount on any desired position on the mask without altering the original structure of the mask.

Another object of the present invention is to provide a Halloween mask with flash device, wherein the flash device can be easily detached from the mask and selectively reinstalled at other position on the mask by the wearer himself or herself.

In order to accomplish the above objects, the present invention provides a Halloween mask which comprises a hollow mask body and at least a flash device. The hollow mask body, which has a predetermined thickness and is made of resilient material such as plastic, rubber or resin, is punctured with a plurality of apertures at predetermined positions. The flash device comprises a base housing having an upper chamber and a lower cavity, a flashing unit being received in the upper chamber of the base housing, a predetermined number of button cell being received in the lower cavity and electrically connected with the flashing unit, a cell cover head having an outer diameter larger than that of the base housing and being detachably connected to a bottom end of the base housing so as to cover the lower cavity and the button cell therein, and a lens member having an outer diameter larger than that of the base housing and being affixed on top of the base housing so as to cover the upper chamber and the flashing unit therein. A neck portion is defined on the base housing between the lens member and the cell cover head. In order to mount the flash device on the mask body, the neck portion, which has an outer diameter slightly larger than a diameter of the corresponding aperture, is positioned at the corresponding aperture on the mask body while the lens member and the cell cover head respectively propping against an exterior surface and an interior surface of the mask body so as to hold and block the flash device in position.

DETAILED DESCRIPTION OF THE PREFERRED EMBODIMENT

Figure 1:
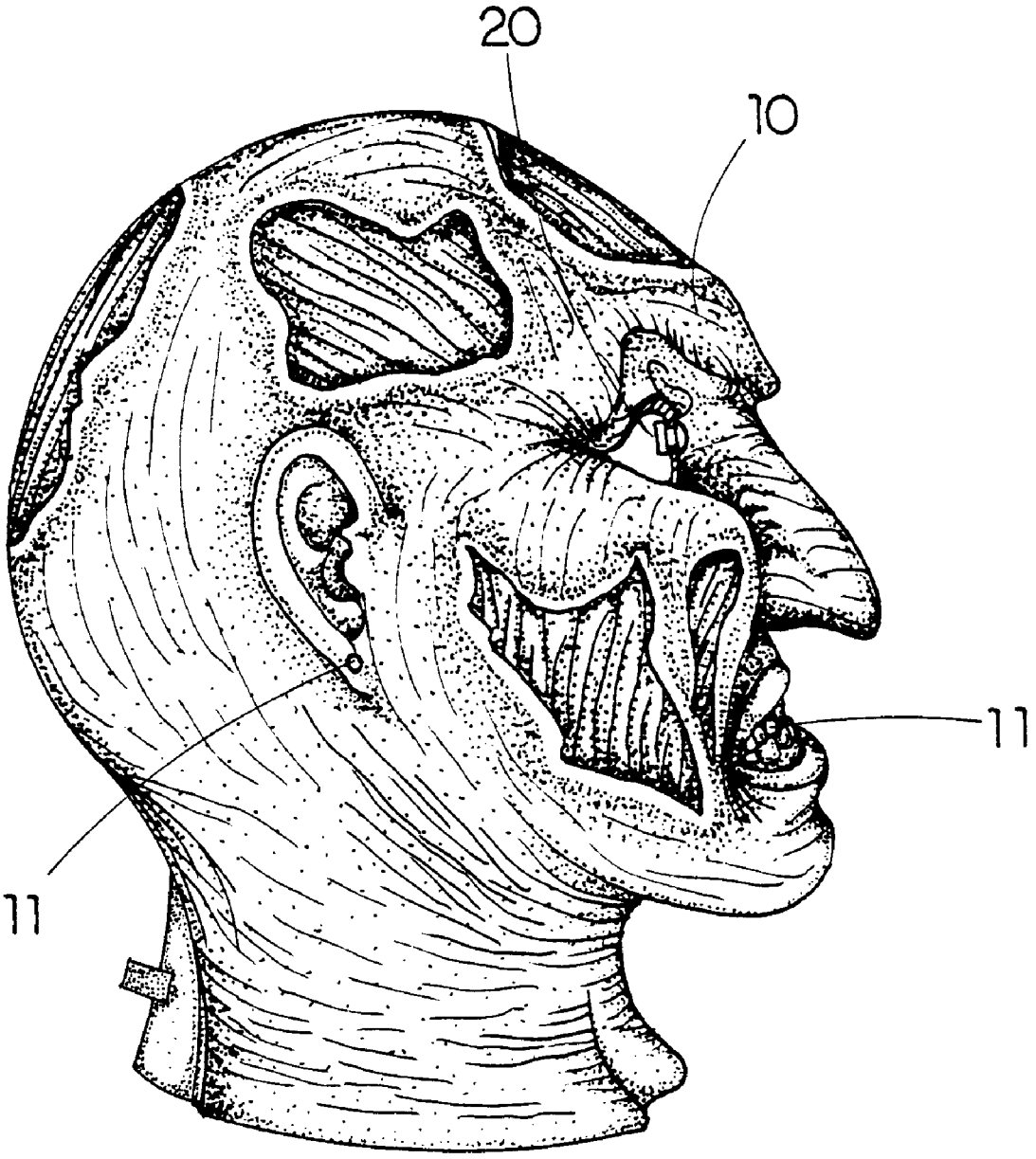
FIG. 1 is a partial sectional view of a Halloween mask with flash device in accordance with a preferred embodiment of the present invention.
Figure 2:
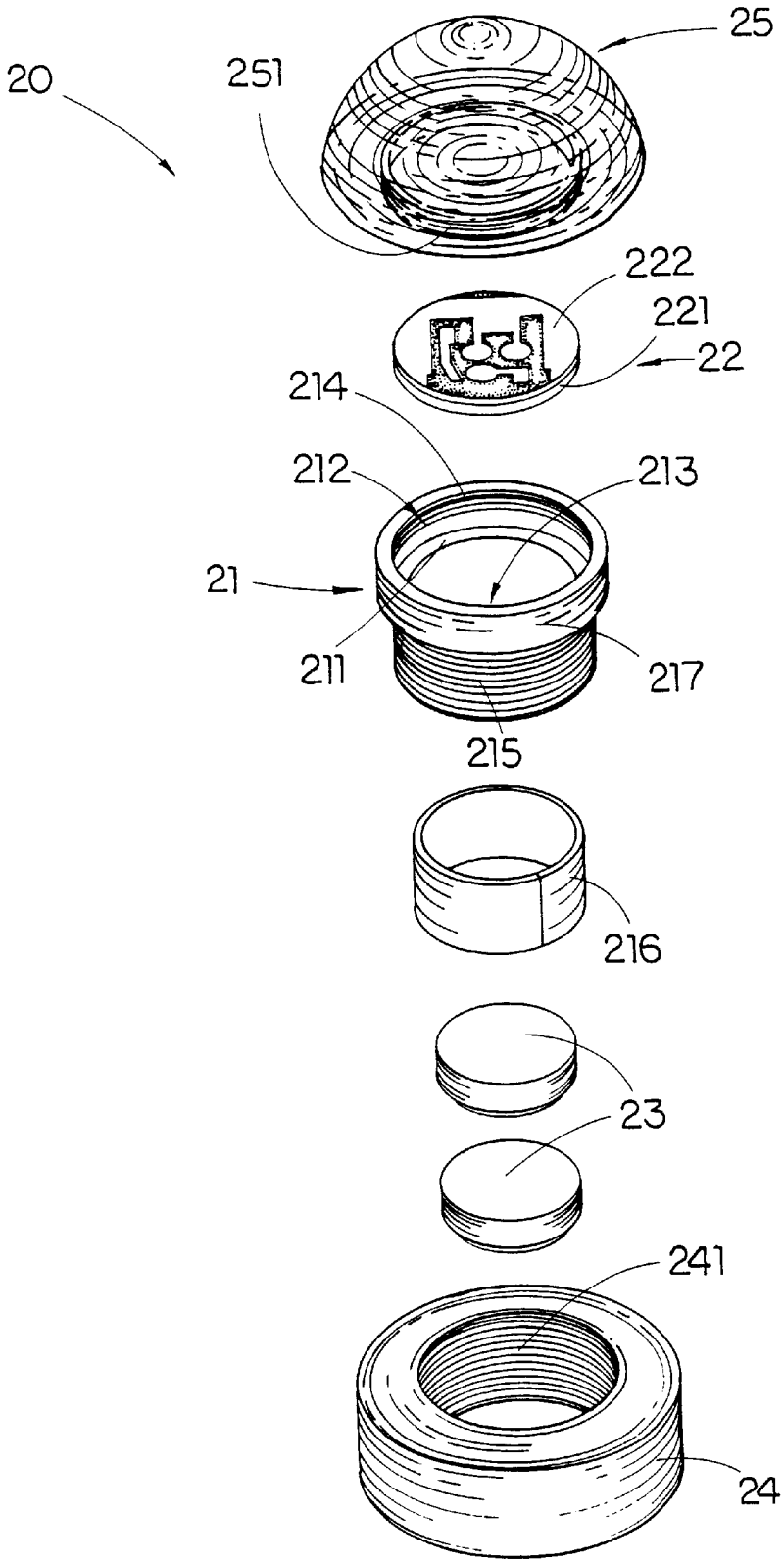
FIG. 2 is an exploded perspective view of a flash device according to the above preferred embodiment of the present invention.
Figure 3:
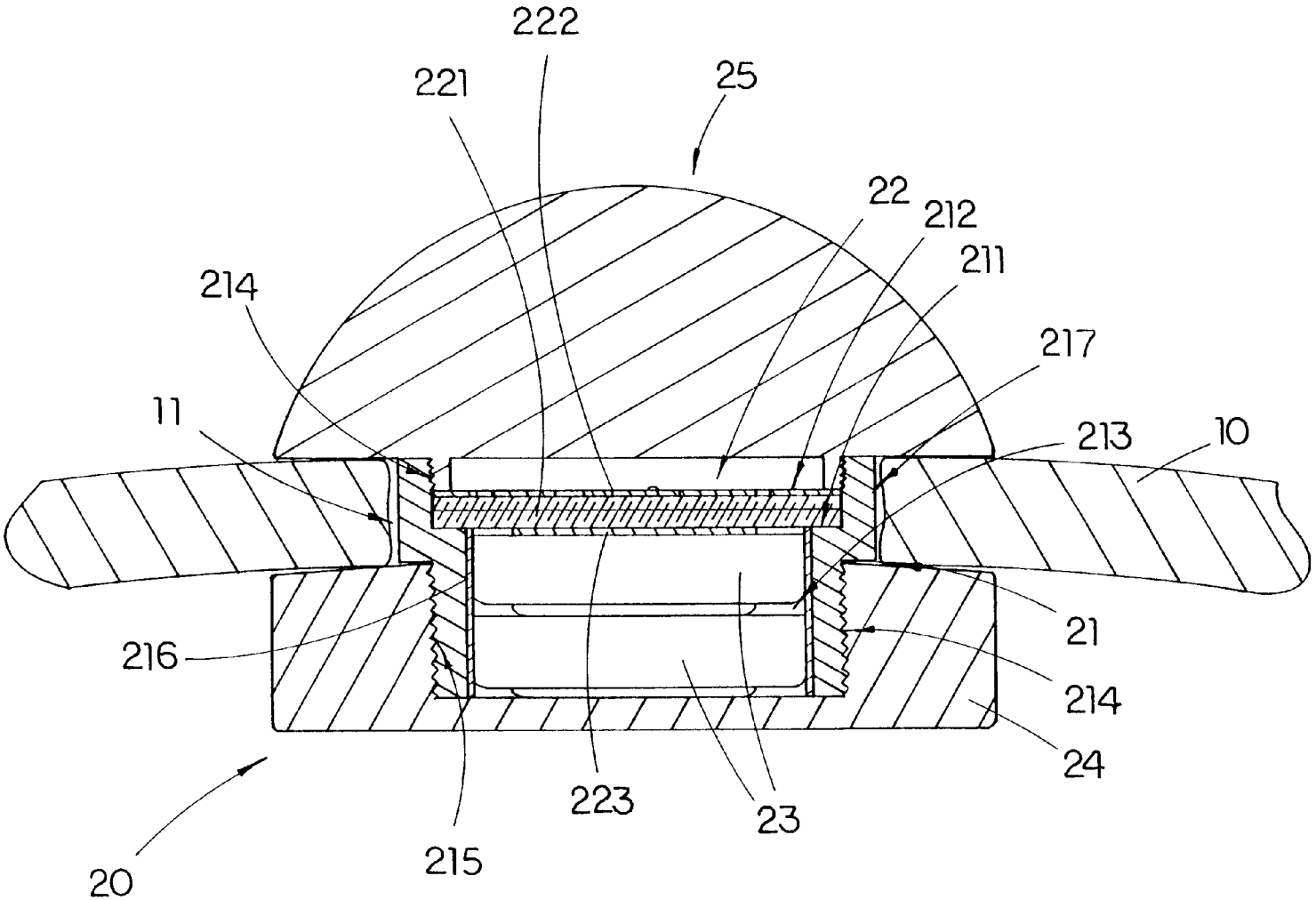
FIG. 3 is a sectional view of the flash device according to the above preferred embodiment of the present invention.

Referring to FIGS. 1 to 3, a Halloween mask with flash device according to a preferred embodiment of the present invention is illustrated, which comprises a head shaped hollow mask body 10 and at least a flash device 20. The hollow mask body 10 has a predetermined thickness and is made of resilient material such as plastic, rubber or synthetic resin. The mask body 10 is punctured with a plurality of apertures 11 at predetermined positions, such as the two eye positions.

The flash device 20, as shown in FIGS. 2 and 3, comprises a base housing 21, a flashing unit 22, a predetermined number of button cell 23, a cell cover head 24, and a lens member 25. The base housing 21 comprises a tubular body which has a shoulder 211 formed at a middle position to define an upper chamber 212 and a lower cavity 213. An upper threaded portion 214 is provided at an inner periphery surface of the upper chamber 212 and a lower threaded portion 215 is provided at an outer periphery surface of a bottom end of the base housing.

The flashing unit 22 comprises a supporting base 221, a micro-LED printed circuit plate 222 affixed on top of the supporting base 221, and an electrical contact plate 223 affixed to a bottom surface of the supporting base 221 and electrically connected with the micro-LED printed circuit plate 222. The flashing unit 22 is fittedly received in the upper chamber 212 and supported by the shoulder 211 of the base housing 21. Adhesive may be used to firmly affixed the flashing unit 22 in the upper chamber 212 to avoid unwanted movement.

At least a button cell 23, preferably two, is received one by one in the lower cavity 213 of the base housing 21 and electrically connected with the flashing unit 22. If the base housing 21 is made of metal, an insulation ring 216 is preferably placed inside the lower cavity 213 so as to form an insulation layer between the circumferential wall of the lower cavity 213 of the base housing 21 and the periphery sides of the button cells 23.

The cell cover head 24 has an outer diameter larger than that of the base housing 21 and a U-shaped cross section. An inner threaded portion 241 is provided on an inner periphery surface of the cell cover head 24. The cell cover head 24 is detachably connected to the bottom end of the base housing 21 by screwing the inner threaded portion 241 with the lower threaded portion 215, so as to cover the lower cavity 213 of the base housing 21 and the button cells 23 therein. The cell cover head 24 can be acted as a switch of the flashing unit 22 when it is made of electrically conducting metal, in which when the cell cover head 24 is screwed tightly until the contact plate 223, the two button cells 23 and the cell cover head 24 are tightly pressed to well contact together, the micro-LED printed circuit plate 222 will then provide flashing light. On the other hands, to slightly unscrew and loosen the cell cover head 24 until the contact plate 223, the two button cells 23 and the cell cover head 24 are not in contact, the flashing light can thus be switched off. Of course, it is apparent that a non-flashing LED lighting can be used to substitute the flashing light.

The lens member 25 is made of transparent material such as plastic in form of a semi-spherical body as shown in FIG. 2 or a diamond shape. The lens member 25 has an outer diameter larger than that of the base housing 21. A connecting neck 251 is integrally protruded underneath for screwing with the upper threaded portion 214 of the upper chamber 212 of the base housing 21 so as to affix the lens member 25 on top of the base housing 21 and cover the upper chamber 212 and the flashing unit 22 therein. Alternatively, the connecting neck 251 of the lens member 25 can be omitted, and the lens member 25 can be directly adhered on top of the base housing 21. The lens member 25 not only can protect the micro-LED printed circuit plate 222 from outside, but also can enhance the flashing light by divergency.

As recited above, both the lens member 25 and the cell cover head 24 have larger outer diameter than the base housing 21, so that a neck portion 217 is defined on the base housing 21 between the lens member 25 and the cell cover head 24. In order to minimize the structural cost of the Halloween mask of the present invention and facilitate the wearer to install the flash device 20 or alter the location of the flash device 20 on the soft mask body 10, the interconnection between the mask body 10 and the flash device 20 must be very simple and easy to operate. According to the present invention, the neck portion 217 is made to have an outer diameter slightly larger than a diameter of the apertures 11, so that the flash device 20 can be mounted on a desired position of the mask body 10 by blocking the neck portion 217 at the corresponding aperture 11 provided on the desired position of the mask body 10 while the lens member 25 and the cell cover head 24 respectively propping against an exterior surface and an interior surface of the mask body 10 so as to hold and block the flash device in position.

The wearer may simply pull the flash device 20 outwardly until the cell cover head 24 is pulled out through the corresponding aperture 11. Then the wearer can re-mount the flash device 20 at another aperture 11 until the neck portion 217 is held and blocked thereon. Accordingly, the Halloween mask with flash device of the present invention not only can increase the attractive effect and the sense of reality for the mask by providing flashing light but also can enhance the safety of the wearer by calling the attention and awareness of the vehicle drivers near the wearer by the flashing light. Moreover, the flash device of the present invention is easy to selectively and firmly mount on any desired position on the mask without altering the original structure of the mask, wherein the flash device can be easily detached from the mask and selectively re-installed at other position on the mask by the wearer himself or herself.

What is claimed is:

1. A Halloween mask, comprising:

a hollow mask body, which has a predetermined thickness and is made of resilient material, being punctured with a plurality of apertures at predetermined positions; and at least a flash device which comprises a base housing having an upper chamber and a lower cavity, a flashing unit for providing flashing light being received in said upper chamber of said base housing, at least a button cell received in said lower cavity and electrically connected with said flashing unit, a cell cover head having an outer diameter larger than that of said base housing and being detachably connected to a bottom end of said base housing so as to cover said lower cavity and said button cell therein, and a lens member which is made of transparent material having an outer diameter larger than that of said base housing and being affixed on top of said base housing so as to cover said upper chamber and said flashing unit therein, wherein a neck portion is defined on said base housing between said lens member and said cell cover head, and that said neck portion, which has an outer diameter slightly larger than a diameter of each of said apertures punctured on said mask body, is mounted at one of said apertures while said lens member and said cell cover head respectively press against an exterior surface and an interior surface of said mask body so as to firmly hold and block said at least a flash device in position.

2. A Halloween mask as recited in claim 1 wherein said base housing comprises a tubular body which has a shoulder formed at a middle position to define said upper chamber and said lower cavity.

3. A Halloween mask as recited in claim 2 wherein an upper threaded portion is provided at an inner peripheral surface of said upper chamber and a lower threaded portion is provided at an outer peripheral surface of said bottom end of said base housing.

4. A Halloween mask as recited in claim 3 wherein said flashing unit comprises a supporting base, a micro-LED printed circuit plate affixed on top of said supporting base, and an electrical contact plate affixed to a bottom surface of said supporting base and electrically connected with said micro-LED printed circuit plate.

5. A Halloween mask as recited in claim 3 wherein said flashing unit is fittedly glued in said upper chamber and supported by said shoulder of said base housing.

6. A Halloween mask as recited in claim 5 wherein an insulation ring is placed inside said lower cavity so as to form an insulation layer between a circumferential wall of said lower cavity of said base housing and a peripheral side of said button cell when said base housing is made of metal.

7. A Halloween mask as recited in claim 6 wherein said cell cover head has a U-shaped cross section and an inner threaded portion provided on an inner peripheral surface thereof, by which said cell cover head is detachably connected to said bottom end of said base housing by screwing said inner threaded portion with said lower threaded portion.

8. A Halloween mask as recited in claim 7 wherein said lens member is firmly adhered on top of said base housing.

9. A Halloween mask as recited in claim 7 wherein said lens member has a connecting neck integrally protruded underneath to screw with said upper threaded portion of said upper chamber of said base housing so as to affix said lens member on top of said base housing and cover said upper chamber and said flashing unit therein.

10. A Halloween mask as recited in claim 3 wherein said cell cover head has a U-shaped cross section and an inner threaded portion provided on an inner peripheral surface thereof, by which said cell cover head is detachably connected to said bottom end of said base housing by screwing said inner threaded portion with said lower threaded portion.

11. A Halloween mask as recited in claim 3 wherein said lens member has a connecting neck integrally protruded underneath to screw with said upper threaded portion of said upper chamber of said base housing so as to affix said lens member on top of said base housing and cover said upper chamber and said flashing unit therein.

12. A Halloween mask as recited in claim 1 wherein said flashing unit comprises a supporting base, a micro-LED printed circuit plate affixed on top of said supporting base, and an electrical contact plate affixed to a bottom surface of said supporting base and electrically connected with said micro-LED printed circuit plate.

13. A Halloween mask as recited in claim 1 wherein an insulation ring is placed inside said lower cavity so as to form an insulation layer between a circumferential wall of said lower cavity of said base housing and a peripheral side of said button cell when said base housing is made of metal.

14. A Halloween mask as recited in claim 1 wherein said lens member is firmly adhered on top of said base housing.

* * * * *